US005247225A

United States Patent [19]

Nakatani et al.

[11] Patent Number: 5,247,225

[45] Date of Patent: Sep. 21, 1993

[54] DISPLAY APPARATUS HAVING SPACED APART ELECTRON BEAM CONTROL ELECTRODES COUPLED TOGETHER BY COUPLING PINS

[75] Inventors: Toshifumi Nakatani, Moriguchi; Fumio Yamazaki, Hirakata; Yuichi Moriyama, Ibaraki; Kanji Imai, Takatsuki, all of Japan

[73] Assignee: Matsushita Electric Industrial Co., Ltd., Osaka, Japan

[21] Appl. No.: 785,751

[22] Filed: Oct. 31, 1991

[30] Foreign Application Priority Data

Nov. 1, 1990 [JP] Japan ..... 2-297962

[51] Int. Cl.[5] ..... H01J 19/12; H01J 29/82

[52] U.S. Cl. ..... 313/495; 313/250; 313/251; 313/257; 313/267; 313/268; 313/417; 313/422; 313/444; 313/456; 313/497

[58] Field of Search ..... 313/495, 497, 506, 378, 313/383, 409, 414, 412, 416, 417, 422, 456, 238, 250, 257, 306, 444, 457, 460, 251, 267, 268, 269

[56] References Cited

U.S. PATENT DOCUMENTS 4,341,980 7/1982 Noguchi et al. ..... 313/495 X
4,853,586 8/1989 Peters ..... 313/495 X
4,887,000 12/1989 Yamazaki et al. ..... 313/495 X

FOREIGN PATENT DOCUMENTS 0284119 9/1988 European Pat. Off. .
0316871 5/1989 European Pat. Off. .
59-148252 8/1984 Japan .
60-218750 11/1985 Japan .

*Primary Examiner*—Donald J. Yusko
*Assistant Examiner*—Ashok Patel
*Attorney, Agent, or Firm*—Wenderoth, Lind & Ponack

[57] ABSTRACT

There is disclosed a display apparatus including a rear electrode unit, electron beam generating sources, a front electrode unit including a plurality of electron beam control electrodes laminated together with insulating spacers therebetween, and a face plate formed with a fluorescent screen. The front electrode is coupled together by first metallic coupling pins fixed on the electron beam control electrode arranged to confront the fluorescent screen. The rear electrode unit is coupled with the electrode unit by second metallic coupling pins fixed to one of the electron beam control electrodes other than the electron beam control electrode confronting the fluorescent screen.

16 Claims, 13 Drawing Sheets

DISPLAY APPARATUS HAVING SPACED APART ELECTRON BEAM CONTROL ELECTRODES COUPLED TOGETHER BY COUPLING PINS

BACKGROUND OF THE INVENTION

The present invention relates to a display apparatus to be employed in a television set, a computer periphery display, or the like.

The conventional display apparatus will be described with reference to the accompanying drawings.

FIG. 19 is a perspective view of essential portions of a conventional display apparatus 301, which includes a rear electrode 302, a plurality of linearly elongated heat electrodes 303 which are sources for generating electron beams, an electrode unit 304, and a face plate 306 formed with a fluorescent screen 305.

In the electrode unit 304, a plurality of electron beam control electrodes 307*a*, 307*b*, 307*c*, and 307*d* are fixedly laminated together by insulating spacers 308*a*, 308*b*, and 308*c*. The spacers 308*a*, 308*b*, and 308*c* are comprised of metallic core members 308*aa*, 308*ba*, 308*ca* and bonding layers 308*ac*, 308*bc*, 308*cc* on both surfaces thereof. The insulating films 308*a* b, 308*b* b and 308*cb* are made of crystalline low melting temperature solder glass, and formed into insulating films by preliminarily sintering and fixing them around core members 308*aa*, 308*ba*, and 308*ca*. The bonding layers 308*ac*, 308*bc*, and 308*cc* are made of amorphous or crystalline low melting temperature soldering glass, and after positioning and laminating the electron beam control electrodes 307*a*,-307*b*, and 307*c* via spacers 308*a*, 308*b*, and 308*c*, the electron beam control electrode 307*a*, 307*b*, and 307*c* are bonded and fixed by blazing, to thereby obtain the electrode unit 304.

The operation of the electrode unit 304 will now be explained.

When a predetermined current is fed to the heat electrodes 303 and predetermined electric potentials are applied to the rear electrode 302, the plurality of electron beam control electrodes 307*a*, 307*b*, 307*c*, 307*d* and the fluorescent screen 305-, electron beams are directed toward the electron beam control electrode 307*a*. The electron beam control electrodes 307*a*, 307*b*, 307*c*, and 307*d* are formed with electron beam passage holes or slits therein, and electron beams are, while passing through these holes or slits, controlled, focused, and deflected by voltages applied to respective electrodes, so that they arrive at the fluorescent screen which has a high voltage applied thereto to generate fluorescent light on the fluorescent screen, to thereby obtain a picture.

However, in the construction of such an electrode unit 304 as referred to above, since the electron beam control electrodes 307*a*, 307*b*, 307*c*, and 307*d* are laminated and fixed to each other via spacers 308*a*, 308*b*, and 308*c*, there arises deformations in the electron beam control electrodes 307*a*, 307*b*, and 307*c* due to variations in the thickness of the insulating films 308*ab*, 308*bb*, and 308*cb* and variations in the thickness of the bonding layers 308*ac*, 308*bc*, and 308*cc*. Furthermore, it is necessary to heat at 400° to 600° C. for bonding and fixing. Therefore, there occurs oxidization due to the high temperatures and deformations due to the thermal stress in the electron beam control electrodes 307*a*, 307*b*, and 307*c*. Furthermore, because the areas of the insulating films 308*ab*, 308*bb*, 308*cb*, and the bonding layers 308*ac*, 308*bc*, 308*cc* between the electron beam control electrodes 307*a*, 307*b*, and 307*c* are comparatively large, respective electrostatic capacitances between the electron beam control electrodes are large resulting in the problem that the power for driving must be increased.

The present invention aims to solve such problems of the conventional art.

SUMMARY OF THE INVENTION

In order to achieve the aforementioned object, according to the present invention, there is provided a display apparatus comprising: a rear electrode unit including a rear electrode; electron beam generating sources; a front electrode unit including a plurality of electron beam control electrodes laminated in spaced apart relation by insulation spacers; and a face plate with a fluorescent screen being formed thereon. The apparatus is constructed so that a first coupling means is arranged on an electron beam control electrode confronting the fluorescent screen for coupling together components of the electrode unit, and a second coupling means is fixed on an electron beam control electrode other than the electron beam control electrode confronting the fluorescent screen for coupling together the rear electrode unit and the front electrode unit.

According to the present invention, there is also provided a display apparatus including: a rear electrode unit including a rear electrode; electron beam generating sources; a front electrode unit including a plurality of electron beam control electrodes laminated one upon another through insulation spacers; and a face plate with a fluorescent screen formed thereon. The apparatus is so arranged that the components of the front electrode unit are coupled together with a coupling means divided at least into two stages in the lamination direction.

According to the present invention, there is further provided a display apparatus including: a rear electrode unit including a rear electrode; electron beam generating sources; a front electrode unit including a plurality of electron beam control electrodes laminated together via insulation spacers; and a face plate formed with a fluorescent screen thereon so arranged that the front electrode unit is divided into at least two units and coupled together by coupling means.

By the above construction according to the present invention, when the front electrode unit is coupled together, the plurality of electron beam control electrodes are laminated together by the coupling means via insulation spacers without the occurrence of deformation thereof and a predetermined spacing is maintained. By constructing the front electrode unit at room temperature without heating, oxidization of the electrode unit and thermal deformation thereof can be prevented. Furthermore, by maintaining the areas of the insulation spacers to the minimum areas necessary to couple the electrodes, the electrostatic capacitances between the electron beam control electrodes can be reduced.

Meanwhile, by coupling together the rear electrode unit and the front electrode unit with the coupling means fixed on an electron beam control electrode other than the electron beam control electrode confronting the fluorescent screen, the electron beam control electrode arranged confronting the fluorescent screen can be prevented from being influenced by the stress arising from coupling of the rear electrode unit with the front electrode unit.

Furthermore, by coupling the front electrode unit with the coupling means divided into at least two stages in the lamination direction or dividing the front electrode unit into at least two units in the lamination direction for coupling together with coupling means, deformations of the electron beam control electrodes due to temperature differences among the respective electron beam control electrodes accompanying heating of the heat electrodes which serve as the electron beam generating sources can be prevented from reaching the electron beam control electrode confronting the fluorescent screen.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

Hereinbelow, a first preferred embodiment of the present invention will be described with reference to the accompanying drawings.

Figure 1:
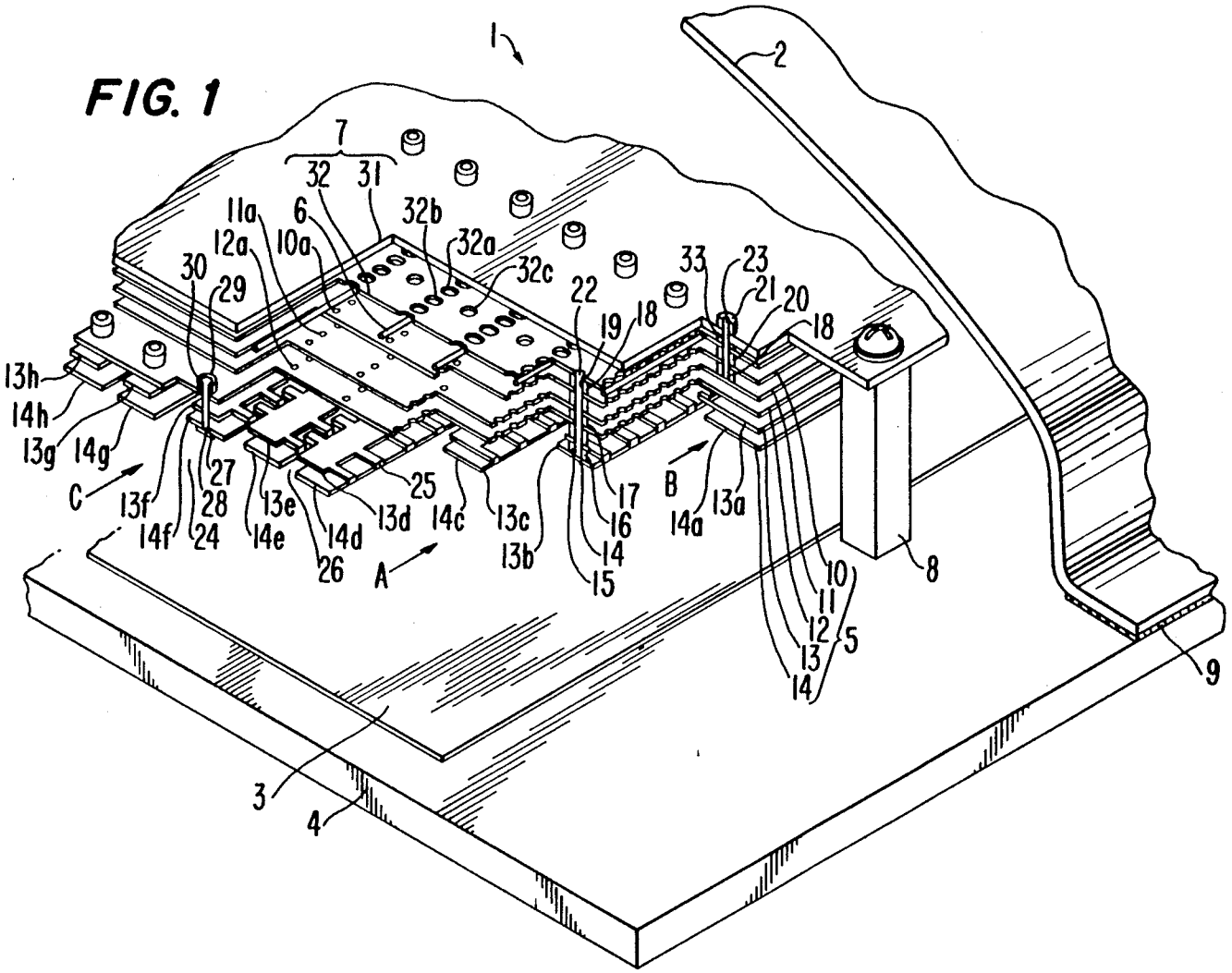
FIG. 1 is a perspective view of essential portions of a display apparatus according to a first preferred embodiment of the present invention.
Figure 2:
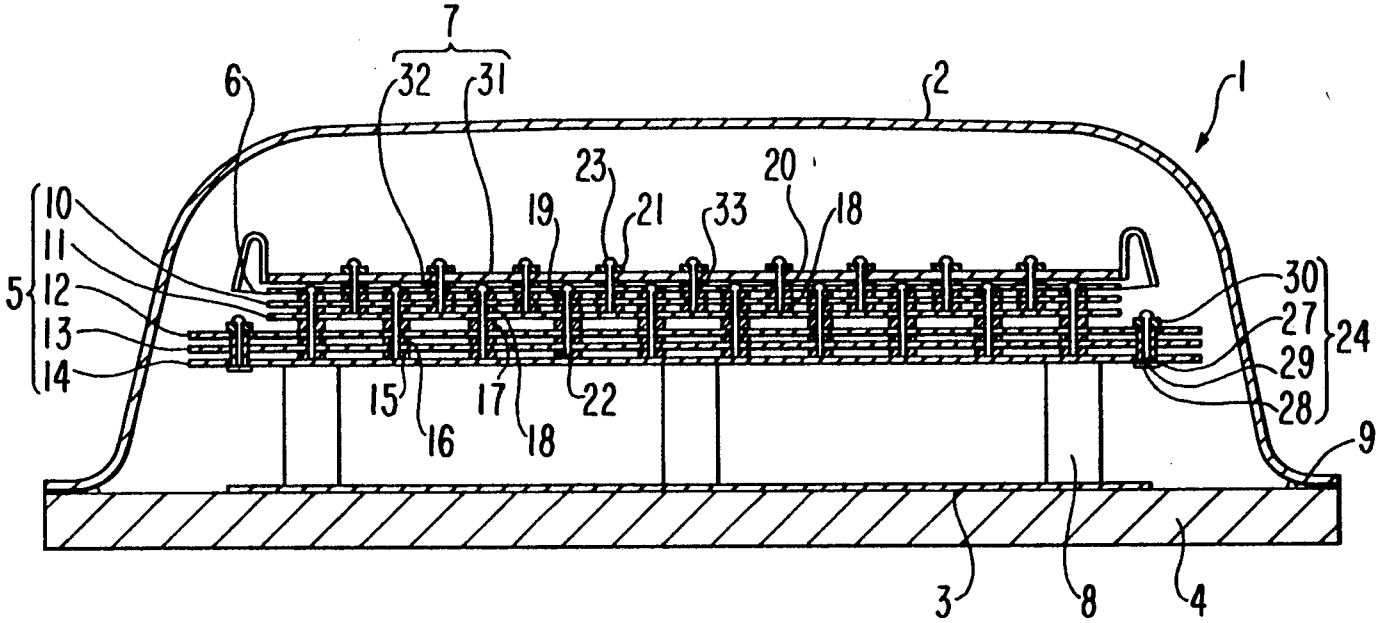
FIG. 2 is a cross-sectional view of the display apparatus according to the first embodiment.
Figure 3:
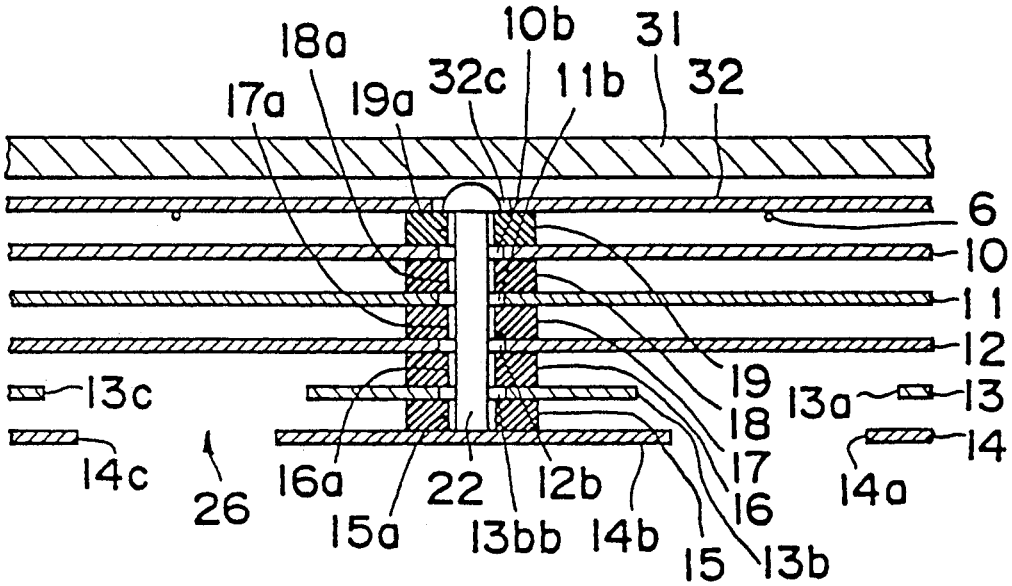
FIG. 3 is a sectional view viewed in the direction of arrow A in FIG. 1.
Figure 4:
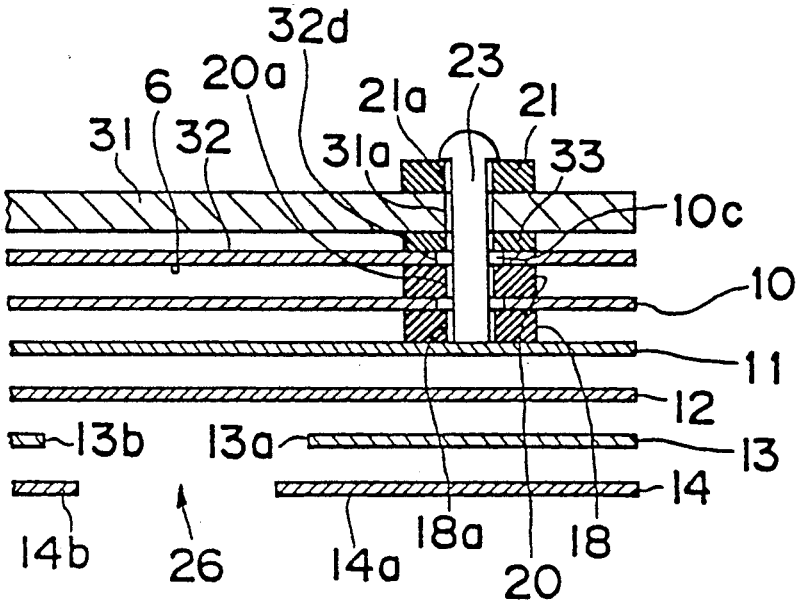
FIG. 4 is a sectional view viewed in the direction of arrow B in FIG. 1.
Figure 5:
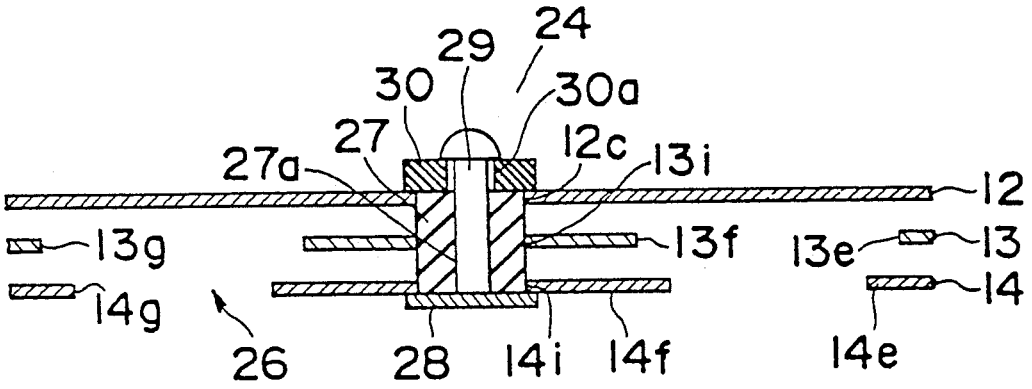
FIG. 5 is a sectional view viewed in the direction of arrow C in FIG. 1.

FIG. 1 is a perspective view of essential portions of a display apparatus according to the present invention, FIG. 2 is a cross-sectional view of the display apparatus of FIG. 1, FIG. 3 is a sectional view viewed in the direction of an arrow A of FIG. 1, FIG. 4 is a sectional view viewed in the direction of an arrow B of FIG. 1, and FIG. 5 is a sectional view viewed in the direction of an arrow C of FIG. 1.

A display apparatus 1 according to the present embodiment is comprised of a rear convered 2, a face plate 4 formed with a fluorescent screen 3, a front electrode unit 5, linearly elongated heat electrodes 6 which serve as electron beam generating sources, and a rear (or second) electrode unit 7. The front electrode unit 5 is coupled in a predetermined position to the rear electrode unit 7 with the heat electrodes 6 arranged at predetermined positions thereof. This rear electrode unit 7 is positioned and fixed onto the face plate 4 with a plurality of posts 8 fixed onto the outer side of the fluorescent screen 3. Furthermore, the periphery of the rear covering 2 is fixed in an airtight manner to the face plate 4 with a low melting point soldering glass 9, etc., and after evacuation through an evacuation tube (not shown), the evacuation tube is sealed, to thereby obtain a display apparatus 1, in which external electrode terminals and a getter, etc. are not shown.

The front electrode unit 5 includes electron beam control electrodes 10, 11, 12, 13, and 14, a plurality of insulation spacers 15, 16, 17, 18, 19, 20, and 21, first pins 22 which serve as a first coupling means for coupling together the components of the front electrode unit 5, second pins 23 as a second coupling means for coupling the front electrode unit 5 with the rear electrode unit 7, and a plurality of positioning restricting means 24 for restricting the positions of strip-shaped electrodes 13*a*, 13*b*, and 13*c* to 13*h* which constitute the electron beam control electrode 13 and the positions of strip-shaped electrodes 14*a*, 14*b*, and 14*c* to 14*h* which constitute the electron beam control electrode 14.

The plate-shaped electron beam control electrodes 10, 11, and 12 have electron beam passage holes 10*a*, 11*a*, and 12*a* provided at respective predetermined positions thereof, and on the strip-shaped electrodes 13*a*, 13*b*, and 13*c* to 13*h* which form the electron beam control electrode 13, comb-shaped projections 25 are formed at predetermined positions thereof. Between respective strip-shaped electrodes 14*a*, 14*b*, and 14*c* to 14*h*, slits 26 are formed at predetermined positions thereof in the longitudinal direction of the linearly elongated heat electrodes 6.

The first metallic pins 22 for coupling the components of the front electrode unit 5 are fixed at predetermined positions of the strip-shaped electrodes 14*a*, 14*b*, and 14*c* to 14*h* by welding or the like. Through holes 15*a* are formed in the insulation spacers 15, through holes 13*b* are formed in the electron beam control electrode 13, through holes 16*a* are formed in the insulation spacers 16, through holes 12*b* are formed in the electron beam control electrode 12, through holes 17*a* are formed in the insulation spacers 17, through holes 11*b* are formed in the electron beam control electrode 11, through holes 18*a* are formed in the insulation spacers 18, through holes 10*b* are formed in the electron beam control electrode 10, and through holes 19*a* are formed in insulation spacers 19. The first pins 22 are inserted through such through holes such that the first pins 22 project from the electron beam control electrode 10, and head portions of the first pins 22 are melted for example by a laser to fix together the electron beam control electrodes 10, 11, 12, 13 and 14.

Meanwhile, since the strip-shaped electrodes 13*a*, 13*b*, and 13*c* to 13*h* constituting the electron beam control electrode 13 and the strip-shaped electrodes 14*a*, 14*b*, and 14*c* to 14*h* constituting the electron beam control electrode 14 are respectively independent, a plurality of the position restricting means 24 are provided on both end portions in the longitudinal direction of the linearly elongated heat electrodes 6. Position restricting holes 12*c* are provided in the plate-shaped electron beam control electrode 12 at both of its end portions in the longitudinal direction of the linearly elongated heat electrodes 6, position restricting holes $\mathbf{13}_i$ are provided in the strip-shaped electrodes 13*a*, 13*b*, and 13*c* to 13*h*, and position restricting holes $\mathbf{14}_i$ are provided in the strip-shaped electrodes 14*a*, 14*b*, and 14*c* to 14*h*. The position restricting holes $\mathbf{13}_i$ and $\mathbf{14}_i$ are of substantially the same diameter as the restricting holes 12*c* and are formed at positions corresponding to the position restricting holes 12*c*. Here, one of the position restricting holes $\mathbf{13}_i$ and $\mathbf{14}_i$ may be elongated in the longitudinal direction of the heat electrodes 6. Bushing 27 are inserted into the position restricting holes 12*c*, $\mathbf{13}_i$ and $\mathbf{14}_i$, and metallic third pins 29 fixed on metallic fixing plates 28 by welding or the like are inserted into through holes 27*a* formed through the bushing 27 from the sides of the strip-shaped electrodes 14*a*, 14*b*, and 14*c* to 14*h*, through holes 30*a* formed on insulation spacers 30 are inserted onto the third pins 29 projecting from the electron beam control electrodes 12, and the head portions of the third pins 29 are melted for example by laser, to thereby constitute the position restricting means 24.

The rear electrode unit 7 is constituted by a rear electrode 31 and a support member 32 for supporting the hot cathodes (i.e. heat electrodes) 6, and the rear electrode 31 and the support member 32 are held at a predetermined spacing by an insulation layer 33. On the rear electrode 31, conductive films divided along a direction normal to the linearly elongated hot cathodes 6 are formed on the side of the hot cathodes 6 via insulation films at the positions corresponding to the electron beam passage holes 10*a*. By applying a predetermined voltage to the conductive films, the electron beam can be modulated. In the support member 32, holes 32*a* are provided at positions corresponding to the electron beam passage holes 10*a*. Furthermore, an insulation layer is formed on the hot cathode side of the support member 32. By contacting the linearly elongated heat electrodes 6 with bars 32*b* between respective holes 32*a* of the support member 32 via an insulation layer, vibration of the hot cathodes 6 is prevented.

On the other hand, the second metallic pins 23 for coupling the front electrode unit 5 with the rear electrode unit 7 are fixed at the predetermined positions of the plate-shaped the front electrode unit 5 with the rear electrode unit, the through holes 18*a* formed in the insulation spacers 18 and the through holes 10*c* formed in the electron beam control electrode 10 are inserted onto the second pins 23. Furthermore, the through holes 20*a* formed in the insulation spacers 20 are inserted onto the second pins 23. On the support member 32 of the rear electrode unit 7, there are formed exit holes 32*c* for the head portions of first pins 22, and through holes 32*d* for the second pins 23. In the rear electrode 31, there are formed through holes 31*a* for the second pins 23 Through holes 21*a* of the insulation spacers 21 are inserted onto the second pins 23 projecting from the rear electrode unit 7, and the head portions of the second pins 23 are melted for example by laser, to thereby couple the electrode unit 5 with the rear electrode unit 7.

In this way, the front electrode unit 5 coupled to the rear electrode unit 7 is constructed. It is to be noted here that the insulation spacers 19 have a thickness equal to or smaller than those of the insulation spacers 20.

Meanwhile, although five electron beam control electrodes are described in the present embodiment, the number of the electron beam control electrodes employed is not limited to the above.

The electron beam control electrode to which the second pins 23 are fixed to couple the front electrode unit 5 with the rear electrode unit 7 may be any of the electrodes so long as it is not the electron beam control electrode 14 confronting the fluorescent screen.

Hereinbelow, the operation of the display apparatus will be described.

When a predetermined voltage is applied to the rear electrode 31, support member 32, and the electron beam control electrode 10, and a predetermined current is fed to the linearly elongated hot cathodes 6, electron beams generated from the hot cathodes pass through the electron beam passage holes 10*a* of the electron beam control electrode 10 and pass through the electron beam passage holes 11*a* and 12*a* of the electron beam control electrodes 11 and 12. The electron beams further pass through the space between the comb-shaped projections 27 of the strip-shaped electrodes 13*a*, 13*b*, and 13*c* to 13*h* of the electron beam control electrode 13, and are deflected in the longitudinal direction of the hot cathodes 6 by applying a larger or smaller voltage than the predetermined voltage to the strip-shaped electrodes 13*a*, 13*b*, and 13*c* to 13*h*. The electron beams further pass through the slits 28 of the electron beam control electrode 14 so as to be deflected in a direction normal to heat electrode 6 through application of a voltage larger or smaller than the predetermined voltage to the strip-shaped electrodes 14*a*, 14*b*, and 14*c* to 14*h*.

In this manner, electron beams are focused, modulated, and deflected while passing through the electron beam control electrodes, and accelerated by the high voltage applied to the fluorescent screen 3 so as to collide with the fluorescent screen 3, to thereby emit fluorescent light to obtain a picture.

According to the above arrangement, with respect to the electrode unit, the plurality of electron beam control electrodes are fixed via insulation spacers to be spaced apart at predetermined intervals without deformation thereof, by the first fixing pins to couple together the components of the front electrode unit. By constructing the front electrode unit at room temperature without heating, oxidization of the electrode unit is prevented, and by maintaining the area of each of the insulation spacers as small as possible, the electrostatic capacitance between each of the electron beam control electrodes can be decreased. For example, in the case of the first embodiment, the electrostatic capacitance can be reduced to 1/10 to 1/20 of that conventionally obtained.

Since coupling of the rear electrode unit with the front electrode unit is effected by the second pins fixed on an electron beam control electrode other than the control electrode confronting the fluorescent screen, the strains which conventionally occur during coupling of the rear electrode unit with the front electrodes unit can be prevented from affecting the strip-shaped electrodes which constitute the electron beam control electrode arranged to confront the fluorescent screen.

By preventing deformations of the strip-shaped electrodes constituting the electron beam control electrode confronting the fluorescent screen, an excellent picture without blurs can be displayed. By maintaining the electrostatic capacitances between the electrodes at a small value, a display apparatus having a small driving power can be obtained.

Hereinbelow, a second preferred embodiment of the present invention will be described with reference to the accompanying drawings.

Figure 6:
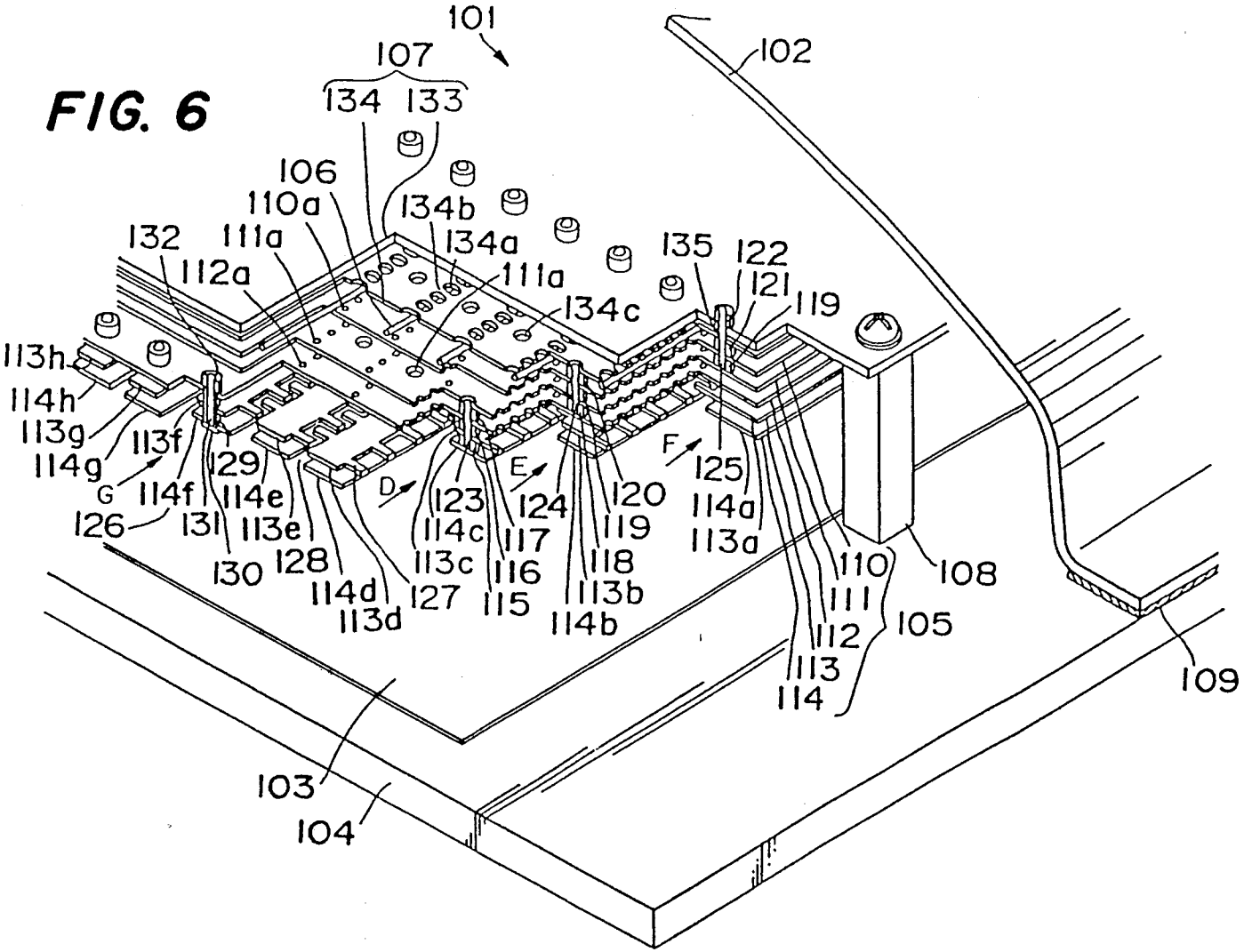
FIG. 6 is a perspective view of essential portions of a display apparatus according to a second preferred embodiment of the present invention.
Figure 7:
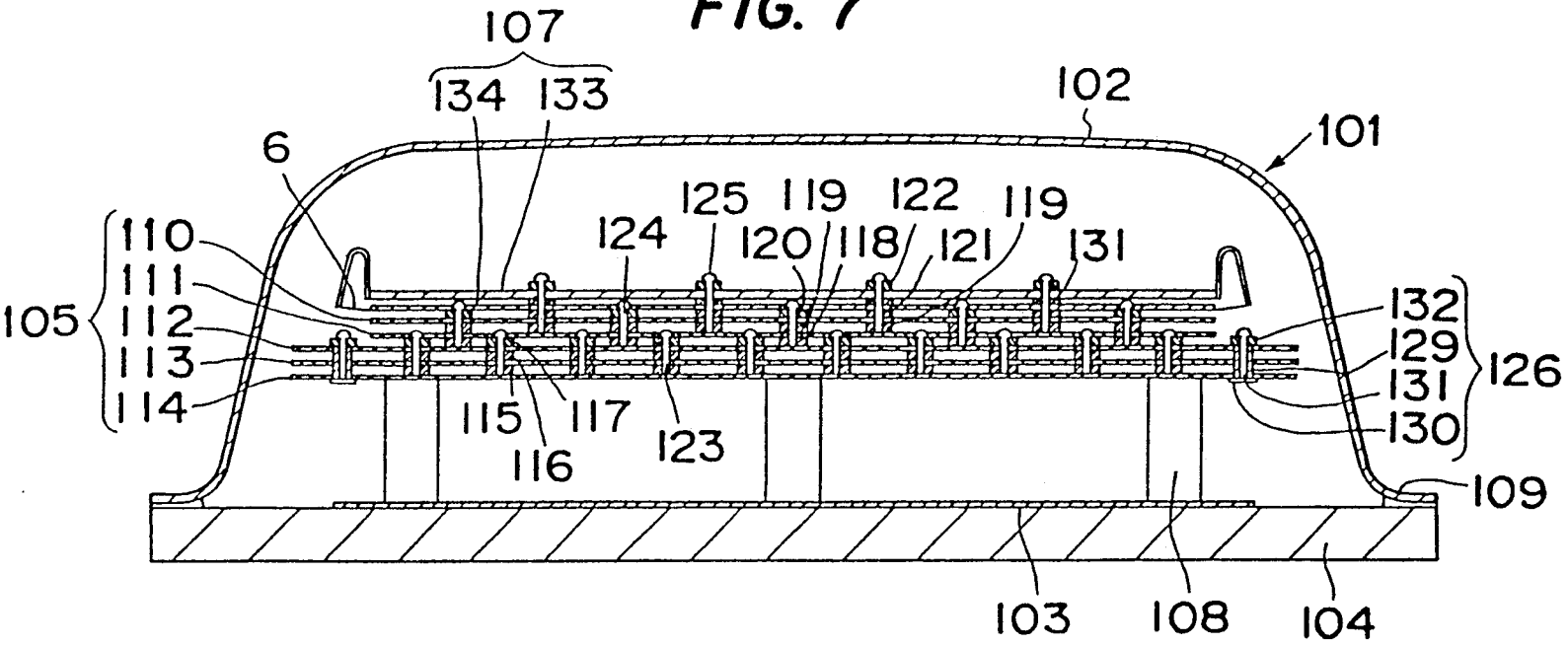
FIG. 7 is a cross-sectional view of the display apparatus according to the second preferred embodiment.
Figure 8:
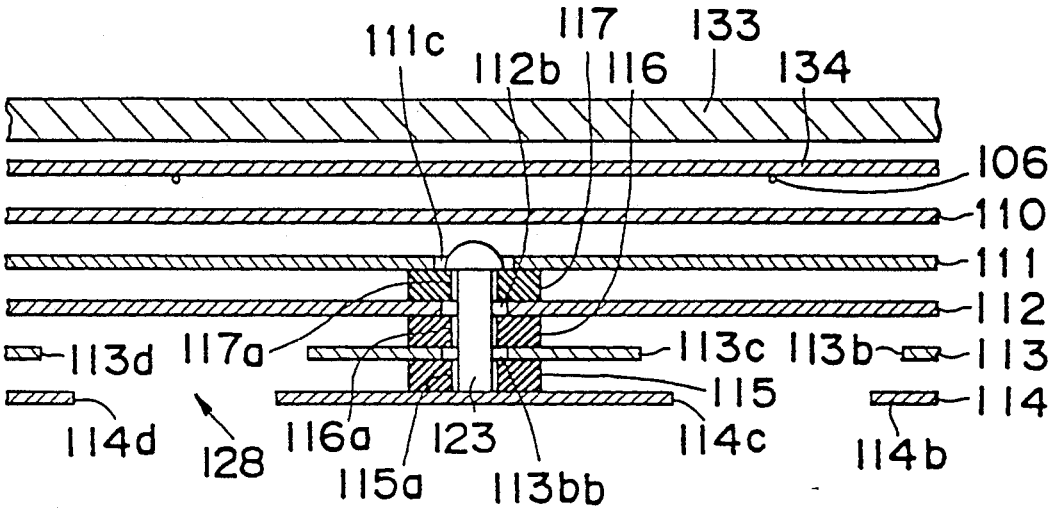
FIG. 8 is a sectional view as viewed in the direction of arrow D in FIG. 6.
Figure 9:
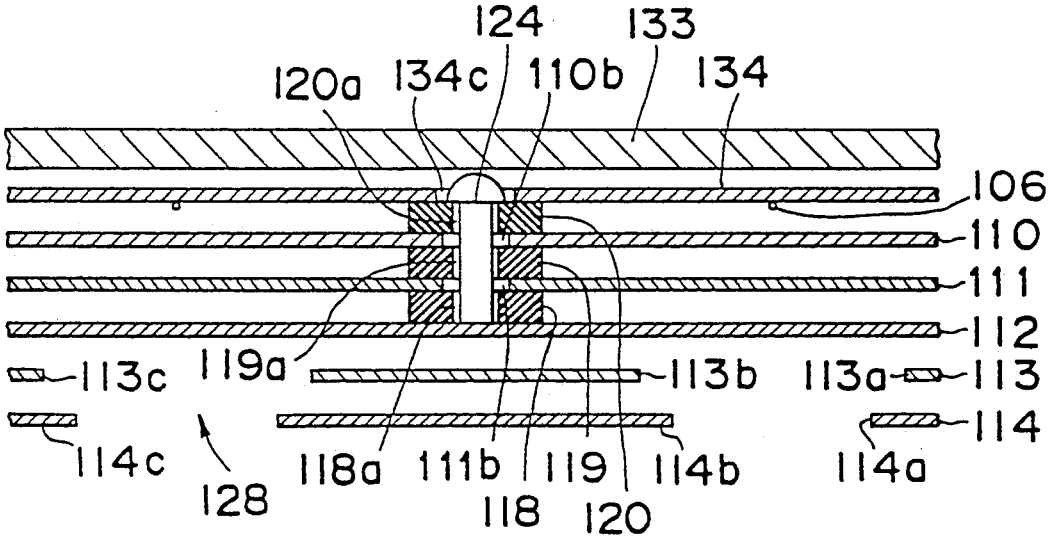
FIG. 9 is a sectional view as viewed in the direction of arrow E in FIG. 6.
Figure 10:
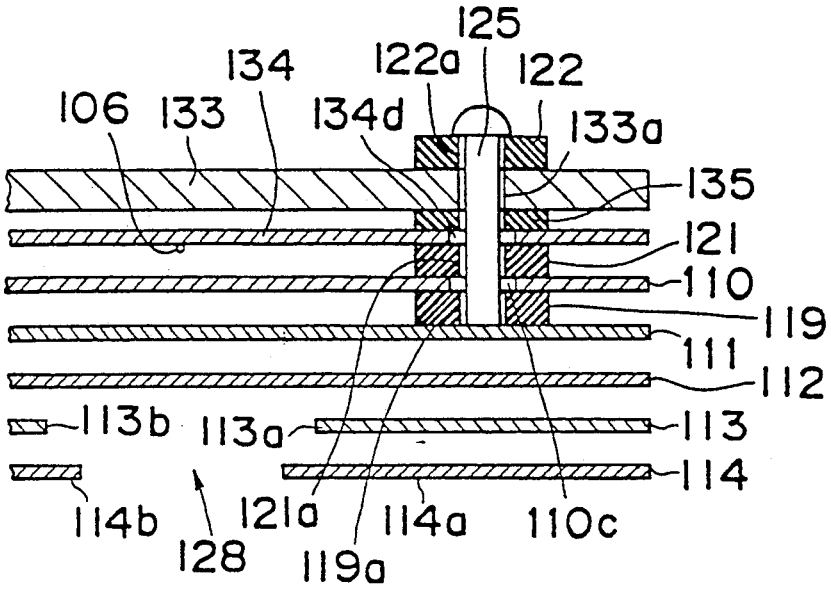
FIG. 10 is a sectional view as viewed in the direction of arrow F in FIG. 6.
Figure 11:
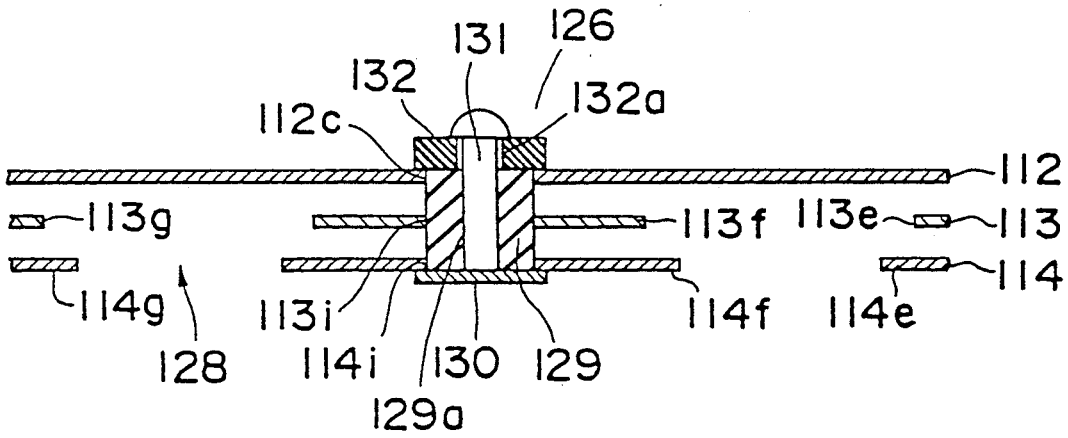
FIG. 11 is a sectional view as viewed in the direction of arrow G in FIG. 6.

FIG. 6 is a perspective view of essential portions of a display apparatus according to the second embodiment of the present invention, FIG. 7 is a cross-sectional view of the display apparatus of FIG. 6, FIG. 8 is a sectional view as viewed in the direction of arrow D in FIG. 6, FIG. 9 is a sectional view as viewed in the direction of arrow E in FIG. 6, FIG. 10 is a sectional view as viewed in the direction of arrow F in FIG. 6, and FIG. 11 is a sectional view as viewed in the direction of arrow G in FIG. 6.

A display apparatus 101 includes a rear covering 102, a face plate 104 formed with a fluorescent screen 103 thereon, a front electrode unit 105, linearly elongated heat electrodes 106 which serve as electron beam generating sources, and a rear electrode unit 107. The heat electrodes 6 are arranged at predetermined positions of the rear electrode unit 107, and the front electrode unit 105 is coupled with the rear electrode unit 107. This rear electrode unit 107 is positioned with respect to the face plate 104 and fixed with set screws onto posts 108 which are fixed on the outer side of the fluorescent screen 103. Furthermore, the rear covering is fixed in an airtight manner to the face plate 104 with a low melting temperature soldering glass 109, or the like. After evacuation through an evacuation tube (not shown), the evacuation tube is sealed to thereby obtain a display apparatus 101. However, external electrode terminals, a getter, etc. are not illustrated.

The front electrode unit 105 includes electron beam control electrodes 110, 111, 112, 113, and 114, a plurality of insulation spacers 115, 116, 117, 118, 119, 120, 121, and 122, first pins 123 and second pins 124 which serve as coupling means for coupling together the components of the front electrode unit 105, third pins 125 which serve as coupling means for coupling the front electrode unit 105 with the rear electrode unit 107, and position restricting means 126 for restricting positions of strip-shaped electrodes 113*a*, 113*b*, and 113*c* to 113*h* which constitute the electron beam control electrode 113 and strip-shaped electrodes 114*a*, 114*b*, and 114*c* to 114*h* which constitute the electron beam control electrode 114.

Plate-shaped electron beam control electrodes 110, 111, and 112 respectively have electron beam passage holes 110*a*, 111*a* and 112*a* on respective predetermined positions, while the strip-shaped electrodes 113*a*, 113*b*, and 113*c* to 113*h* which constitute the electron beam control electrode 113 respectively have comb-shaped projections 127 at predetermined positions thereof and the strip-shaped electrodes 114*a*, 114*b*, and 114*c* to 114*h* which constitute the electron beam control electrode 114 respectively have slits 128 formed therebetween at predetermined positions thereof in the longitudinal direction of the heat electrodes 106.

The metallic first pins 123 for coupling together the components of a first stage of the front electrode unit 105 are fixed to the strip-shaped electrodes 114*a*, 114*b*, and 114*c* to 114*h* at predetermined position thereof by welding, etc. Through holes 115*a* formed in the insulation spacers 115, through holes 113*bb* formed in the electron beam control electrodes 113, through holes 116*a* formed in the insulation spacers 116, and through holes 112*b* formed in the electron beam control electrode 112 are inserted on the first pins 123. Through holes 117*a* formed in the insulation spacers 117 are inserted on the first pins 123 projecting from the electron beam control electrode 112. The head portions of the first pins 123 are melted by laser, etc., to thereby couple the electron beam control electrodes 112, 113, and 114.

Meanwhile, the second metallic pins 124 for coupling together the components of a second stage of the front electrode unit 105 are fixed to the electron beam control electrode 112 at predetermined positions thereof by welding, etc. onto the second pins 124, through holes 118*a* formed in insulation spacers 118, through holes 111*b* formed in the electron beam control electrode 111, through holes 119*a* formed in the insulation spacers 119 and through holes 110*b* formed in the electron beam control electrode 110 are inserted, and through holes 120*a* formed in the insulation spacers 120 are inserted onto the second pins 124 projecting from the electron beam control electrode 110. By melting the head portions of the second pins 124 by laser, etc., the electron beam control electrodes 110, 111, 112, 113, and 114 are coupled together.

Here, in the electron beam control electrode 111, there are provided exit holes 111*c* for the head portions of the first pins 123.

As described above, the components of the front electrode unit 105 are coupled together in two divided stages by means of the first pins 123 and the second pins 124.

Furthermore, since the strip-shaped electrodes 113*a*, 113*b*, and 113*c* to 113*h* which constitute the electron beam control electrode 113 and the strip-shaped electrodes 114*a*, 114*b*, and 114*c* to 114*h* which constitute the electron beam control electrode 114 are independent of one another, a plurality of position restricting means 126 are arranged along the longitudinal directions of the linearly elongated heat electrodes 106. On both end portions of the plate-shaped electron beam control electrode 112 in the longitudinal direction of the heat electrodes 106, position restricting holes 112*c* are formed, and on the strip-shaped electrodes 113*a*, 113*b*, and 113*c* to 113*h* and the strip-shaped electrodes 114*a*, 114*b*, and 114*c* to 114*h*, position restricting holes $\mathbf{113}_i$ and $\mathbf{114}_i$ of substantially the same diameter as the hole 112*c* are formed at positions corresponding to the hole 112*c*. Here also, one of the position restricting holes $\mathbf{113}_i$ and $\mathbf{114}_i$ may be elongated along the longitudinal direction of the heat electrodes 106. Position restricting bushings 129 are inserted into the position restricting holes 112*c*, $\mathbf{113}_i$ and $\mathbf{114}_i$. Fourth metallic pins 131 are fixed to metallic fixing plates 130 by welding, etc. and are inserted into through holes 129*a* formed in the bushings 129 from the sides of the strip-shaped electrodes 114*a*, 114*b*, and 114*c* to 114*h*. Through holes 132*a* formed in the insulation spacers 132 are inserted onto fourth pins 131 projecting from the electron beam control electrode 112, and the head portions of the fourth pins 131 are melted, to thereby constitute the position restricting means 126.

The rear electrode unit 107 includes a rear electrode 133 and a support member 134 for supporting the heat electrodes 106, and the rear electrode 133 and the support member 134 are maintained spaced apart at a predetermined interval by an insulation layer 135 On the rear electrode 133, conductive films divided along the direction normal to the linearly elongated heat electrodes 106 are formed at positions corresponding to the electron beam passage holes 110*a* via an insulation layer on the side of hot cathodes (i.e. heat electrodes) 106. By applying a predetermined voltage to the conductive films, electron beams are modulated. Holes 134*a* are provided in the support member 134 at positions corresponding to electron beam passage holes 110*a*. Furthermore, on the support member 134, there is provided an insulation layer on the hot cathodes 106 side thereof. By contacting the linear hot cathodes 106 with bars between respective holes 134*a* of the support member 134, vibration of the heat electrodes 106 is prevented.

Meanwhile the third metallic pins 125 for coupling the front electrode unit 105 with the rear electrode unit 107 are fixed to the plate-shaped electron beam control electrode 111 at predetermined positions. In coupling the electrode unit 105 with the rear electrode unit 107, the through holes 119*a* formed in the insulation spacers 119 and the through holes 110*c* formed in the electron beam control electrode 110 are inserted onto third pins 125. Furthermore, the through holes 121*a* formed in the insulation spacers 121 are inserted onto the third pins 125. In the support member 134 of the rear electrode unit 107, there are formed exit holes 134*c* for the head portions of the second pins 124 for coupling together components of the front electrode unit 105, and through holes 134*d* for the third pins 125. In the rear electrode 133, there are formed through holes 133*a* for the third pins 125. Thus, the electrode unit 105 and the rear electrode unit 107 are coupled together by inserting the through holes 122*a* in insulation spacers 122 onto the third pins 125 projecting from the rear electrode unit 107, and then melting the head portions of the third pins 125, for example, by laser.

In this way, the front electrode unit 105 coupled to the rear electrode unit 107 is constructed.

Here, each of the insulation spacers 117 has a thickness equal to or smaller than that of the insulation spacers 118, and each of the insulation spacers 120 has a thickness equal to or smaller than that of the insulation spacers 121.

Meanwhile, in the present embodiment, although five electron beam control electrodes are mentioned, the number of electrodes is not limited to five, and the electron beam control electrodes coupled together by the first pins 123 are not limited to the above-mentioned electrodes 112, 113, and 114. The electron beam control electrode to which the second pins 124 are fixed may be any of the electron beam control electrodes coupled together by the first pins 123 so long as it is not the electron beam control electrode 114 confronting the fluorescent screen 103.

The electron beam control electrode to which the third pins 125 are fixed for coupling the front electrode unit 105 with the rear electrode unit 107 may be any electron beam control electrode excluding the electron beam control electrode 114 confronting the fluorescent screen 103.

Furthermore, the front electrode unit 105 may be divided into more than three stages in the lamination direction.

Since the operation thereof is the same as for the first embodiment, the description thereof is omitted.

According to the above-described arrangement of the present embodiment, due to the fact that the front electrode unit is fixed in two stages by the first and the second pins without deforming the electron beam control electrodes and a predetermined spacing is maintained between respective electrodes, and the front electrode unit is constructed at room temperature without heating, oxidization thereof can be prevented. Furthermore, by maintaining the areas of the respective insulation spacers to the smaller possible areas necessary for coupling purposes, the electrostatic capacitances between the respective electrodes can be decreased. For example, in the case of the second embodiment, the electrostatic capacitance can be made 1/10 to 1/20 of the value obtained conventionally.

Furthermore, since the electrode unit is divided in the lamination direction and coupled together by the first and second pins, and the second pins are fixed to an electron beam control electrode other than the electron beam control electrode confronting the fluorescent screen, deformations of the electron beam control electrodes arising from temperature differences therebetween accompanying the heating of the heat electrodes can be prevented from affecting the strip-shaped electrodes which constitute the electron beam control electrode confronting the fluorescent screen.

Furthermore, since the coupling of the front electrode unit with the rear electrode unit is effected by the third pins fixed onto an electron beam control electrode other than that confronting the fluorescent screen, strains arising from coupling the rear electrode unit with the front electrode unit can be prevented from reaching the electron beam control electrode confronting the fluorescent screen.

By preventing deformations of the strip-shaped electrodes arranged to confront the fluorescent screen in this manner, an excellent blur-less picture can be displayed, and by maintaining the electrostatic capacitances between respective electrodes as low as possible, a display apparatus having a small driving power can be obtained.

Subsequently, a third preferred embodiment of the present invention will be described with reference to the accompanying drawings.

Figure 12:
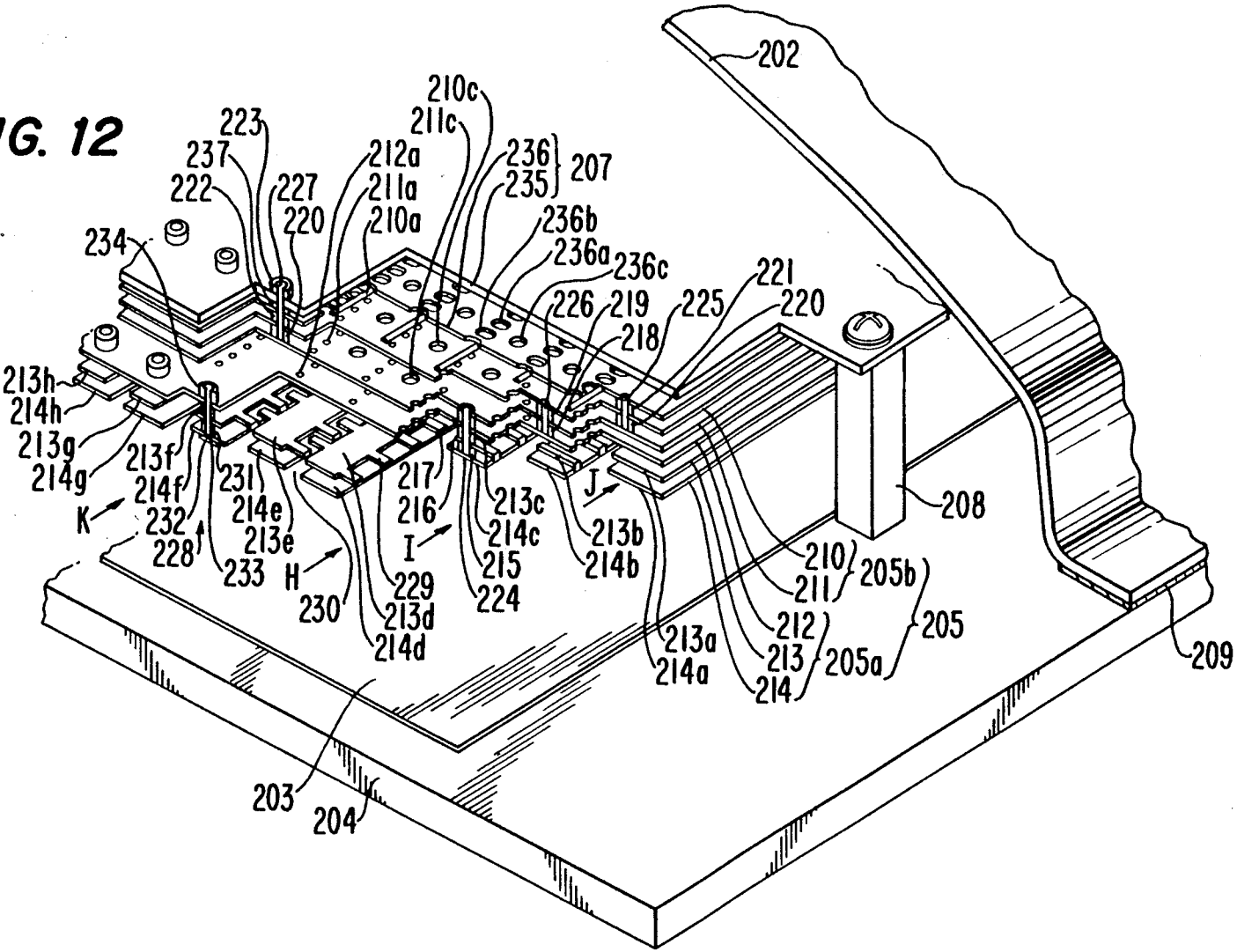
FIG. 12 is a perspective view of essential portions of a display apparatus according to a third preferred embodiment of the present invention.
Figure 13:
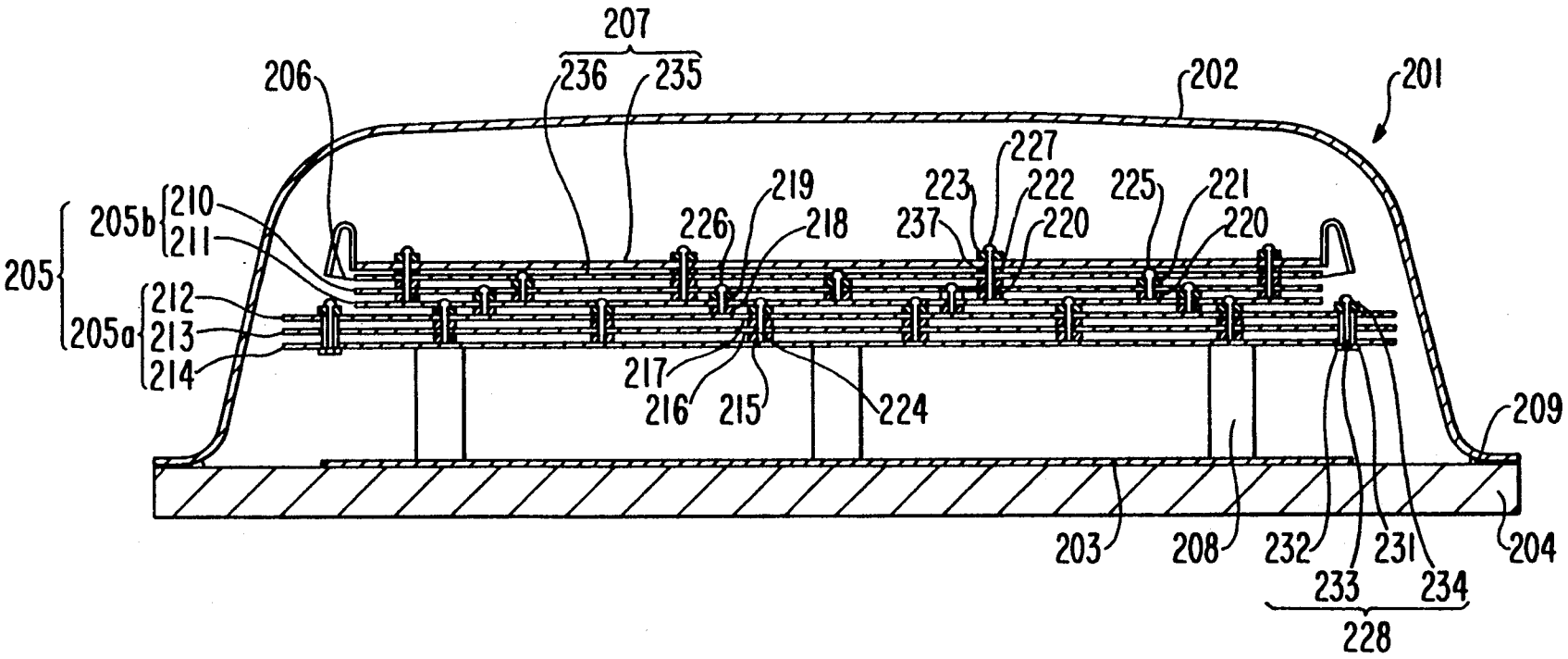
FIG. 13 is a cross-sectional view of the display apparatus according to the third preferred embodiment.
Figure 14:
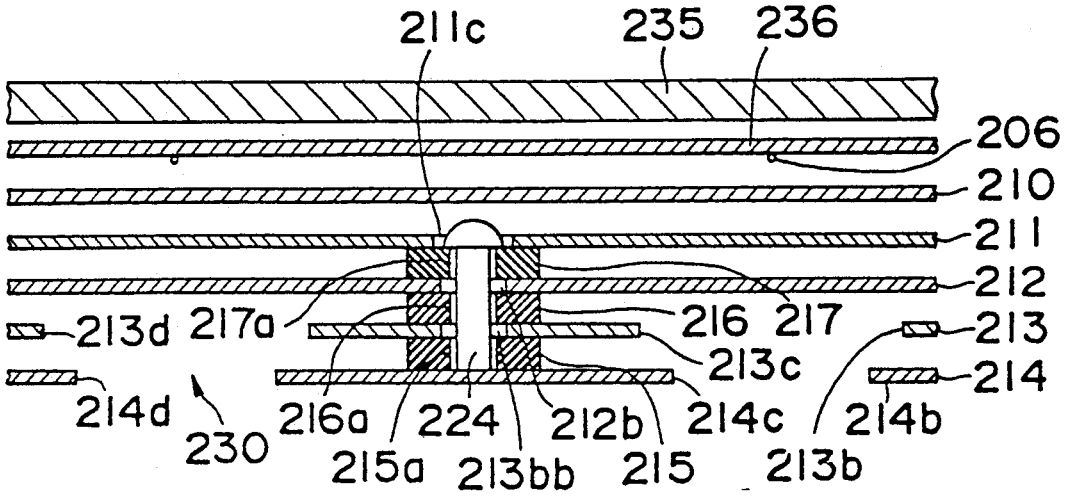
FIG. 14 is a sectional view as viewed in the direction of arrow H in FIG. 12.
Figure 15:
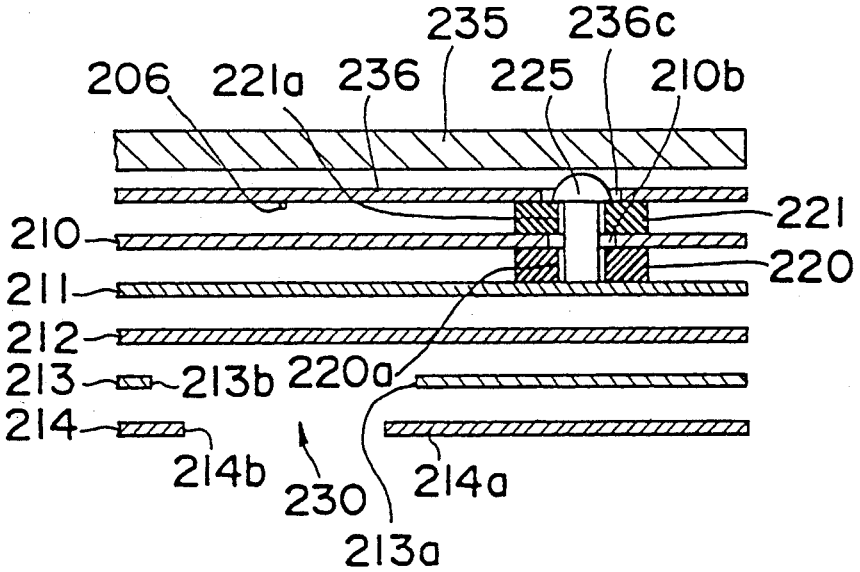
FIG. 15 is a sectional view as viewed in the direction of arrow I in FIG. 12.
Figure 16:
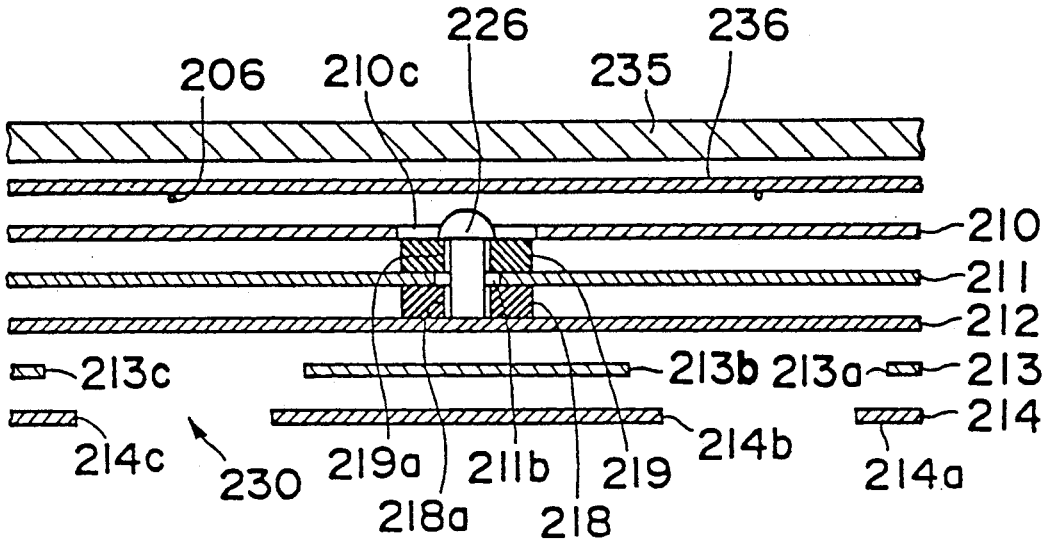
FIG. 16 is a sectional view as viewed in the direction of arrow J in FIG. 12.
Figure 17:
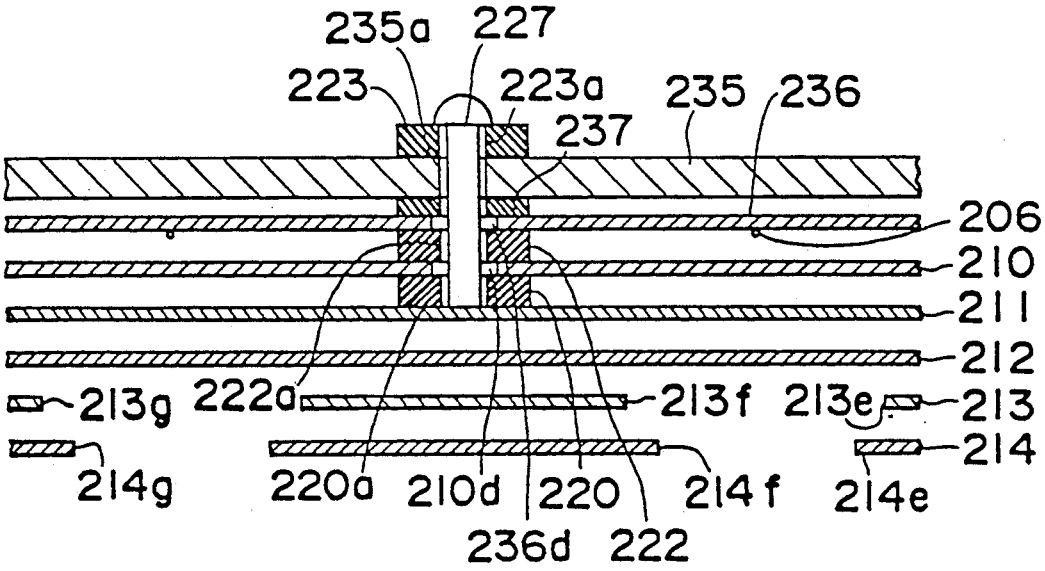
FIG. 17 is a sectional view as viewed in the direction of arrow K in FIG. 12.
Figure 18:
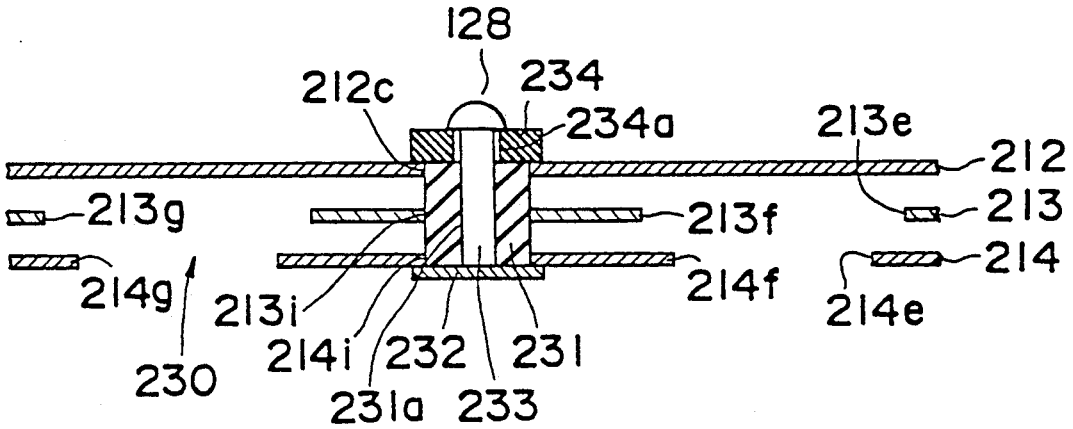
FIG. 18 is a sectional view as viewed in the direction of arrow L in FIG. 12.
Figure 19:
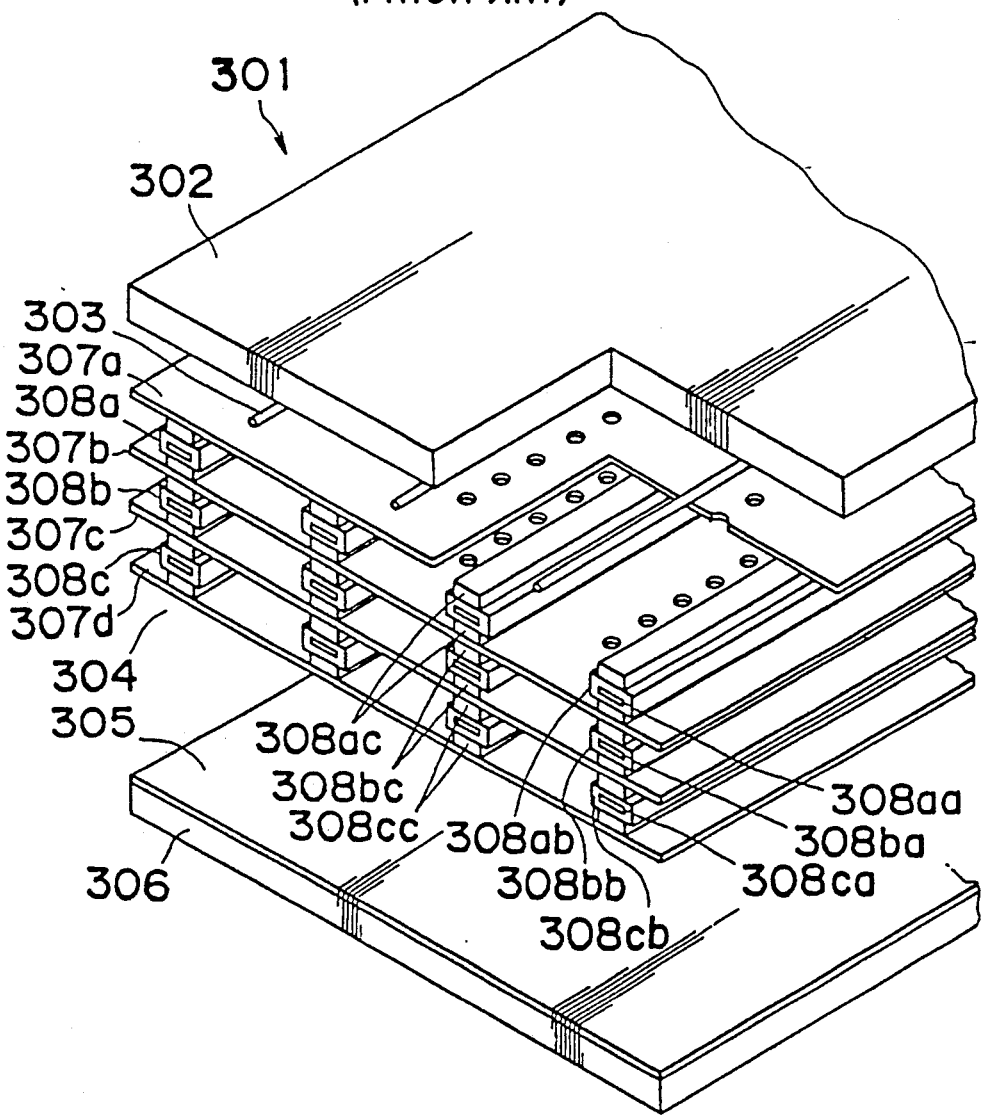
FIG. 19 (PRIOR ART)
FIG. 19 is a perspective view of essential portions of a conventional display apparatus.

FIG. 12 is a perspective view of essential portions of a display apparatus according to the third embodiment of the invention, FIG. 13 is a cross-sectional view of the display apparatus of FIG. 12, FIG. 14 is a sectional view as viewed in the direction of arrow H in FIG. 12, FIG. 15 is a sectional view as viewed in the direction of arrow I in FIG. 12, FIG. 16 is a sectional view as viewed in the direction of arrow J in FIG. 12, FIG. 17 is a sectional view as viewed in the direction of arrow K in FIG. 12, and FIG. 18 is a sectional view as viewed in the direction of arrow L in FIG. 12.

A display apparatus 201 includes a rear covering 202, a face plate 204 formed with a fluorescent screen 203, a front electrode unit 205, linearly elongated heat electrodes 206, and a rear electrode unit 207. The electrode unit 205 is coupled with the rear electrode unit 207 at predetermined positions, and the heat electrodes 206 are arranged along predetermined positions of the rear electrode unit 207. This rear electrode unit 207 is positioned and fixed onto the face plate 204 by a plurality of posts 208 fixed to the outer side of the fluorescent screen 207 with set screws. Furthermore, the rear covering 202 is fixed in an airtight manner to the face plate 204 with a low melting point soldering glass 209, etc., and after evacuation through an evacuation tube (not shown), the evacuation tube is sealed, to thereby obtain the display apparatus 201. However, external electrode terminals, a getter, etc. are not shown.

The front electrode unit 205 includes electron beam control electrodes 210, 211, 212, 213, and 214, a plurality of insulation spacers 215, 216, 217, 218, 219, 220, 221, 222, and 223, first, second and third pins 224, 225, and 226 which serve as a coupling means for coupling together components of the front electrode unit 205, fourth pins 227 which serve as a coupling means for coupling the front electrode unit 205 with the rear electrode unit 207, and a plurality of position restricting means for restricting positions of strip-shaped electrodes 213*a*, 213*b*, and 213*c* to 213*h* which constitute the electron beam control electrode 213, and strip-shaped electrodes 214*a*, 214*b*, and 214*c* to 214*h* which constitute the electron beam control electrode 214.

The plate-shaped electron beam control electrodes 210, 211, and 212 respectively have electron beam passage holes 210*a*, 211*a*, and 212*a* formed therein at predetermined positions, while the strip-shaped electrodes 213*a*, 213*b*, and 213*c* to 213*h* which constitute the electron beam control electrode 213 have comb-shaped projections 229 formed at respective predetermined positions thereon. Also, the strip-shaped electrodes 214*a*, 214*b*, and 214*c* to 214*h* which constitute the electron beam control electrode 214 have slits 230 formed therebetween at predetermined positions along the longitudinal directions of the linearly elongated heat electrode 206.

The front electrode unit 205 is divided into a front electrode section 205*a* which includes the electron beam control electrodes 212, 213 and 214 and a second electrode section 205*b* which includes the electron beam control electrodes 210 and 211.

First metallic pins 224 for coupling together components of the first electrode section 205*a* are fixed to the strip-shaped electrodes 214*a*, 214*b*, and 214*c* to 214*h* of the electron beam control electrode 214 at predetermined positions thereof by welding, etc. Through holes 215*a* formed in the insulation spacers 215, through holes 212*b* formed in the electron beam control electrode 212, through holes 216*a* formed in the insulation spacers 216 and through holes 213*bb* formed in the electron beam control electrode 213 are inserted onto the first pins 224, and through holes 217*a* formed in the insulation spacers 217 are inserted onto the first pins 224 projecting from the electron beam control electrode 212, and the head portions of the first pins 224 are melted for example, by laser, to thereby couple together the components of the first electrode section 205*a*.

Second metallic pins 225 for coupling together components of the second electrode section 205*b* are fixed on the electron beam control electrode 211 at predetermined positions by welding, etc. Through holes 220*a* formed in the insulation spacers 220, and through holes 210*b* formed in the electron beam control electrode 210 are inserted onto the second pins 225, through holes 221*a* formed in the insulation spacers 221 are inserted onto the second pins 225 projecting from the electron beam control electrode 210, and the head portions of the second pins 225 are melted, for example, by laser, to thereby couple together the components of the second electrode section 205*b*.

Furthermore, the first electrode section 205*a* and the second electrode section 205*b* are coupled together by the third pins 226 which are fixed to the electron beam control electrode 212 at predetermined positions by welding, etc. The third pins 226 are inserted into through holes 218*a* formed in the insulation spacers 218 and through holes 211*b* formed in the electron beam control electrode 211. Through holes 219*a* formed in the insulation spacers 219 are inserted onto the second pins 226 projecting from the electron beam control electrode 211, and the head portions of the third pins 226 are melted, for example, by laser, to thereby couple together the first electrode section 205*a* and the second electrode section 205*b*.

Here, exit holes 211*c* for the head portions of the first pins 224 are formed in the electron beam control electrode 211, and through holes 210*c* for the fixing portions of the third pins 226 are formed in the electron beam control electrode 210.

As described above, the front electrode unit 205 is divided into two sections, i.e. the first electrode section 205*a* and the second electrode section 205*b* which respectively have their components coupled together by means of the first pins 224 and the second pins 225. The first electrode section 205*a* and the second electrode section 205*b* are coupled together by means of the third pins 226, to thereby construct the front electrode unit 205.

Meanwhile, since the strip-shaped electrodes 213*a*, 213*b*, and 213*c* to 213*h* which constitute the electron beam control electrode 213 and the strip-shaped electrodes 214*a*, 214*b*, and 214*c* to 214*h* which constitute the electron beam control electrode 214 are respectively independent, a plurality of position restricting means 228 are provided on both end portions thereof along the longitudinal directions of the linearly elongated heat electrodes 206. On both of the end portions of the plate-shaped electron beam control electrode 212 in the longitudinal direction of the heat electrodes 206, there are provided position restricting holes 212*c*, and on the strip-shaped electrodes 213*a*, 213*b*, and 213*c* to 213*h* and the strip-shaped electrodes 214*a*, 214*b*, and 214*c* to 214*h*, there are provided position restricting holes $\mathbf{213}_i$ and $\mathbf{214}_i$ of substantially the same diameter as the position restricting holes 212*c* at position corresponding to the position restricting holes 212*c*. It is to be noted here that one of each position restricting hole $\mathbf{213}_i$ and each position restricting hole $\mathbf{214}_i$ may be elongated in the longitudinal direction of the linearly elongated heat electrodes 206. Position restricting bushings 231 are inserted into the position restricting holes 212*c*, $\mathbf{213}_i$ and $\mathbf{214}_i$.

Metallic fifth pins 233 fixed to the fixing plate 232 by welding, etc. are inserted into through holes 231*a* formed in the bushings 231 from the sides of strip-shaped electrodes 214*a*, 214*b*, and 214*c* to 214*h*. Through holes 234*a* formed in the insulation spacer 234 are inserted onto the fifth pins 233 projecting from the electron beam control electrode 212, and the head portions of the fifth pins 233 are melted, for example, by laser, to thereby constitute the position restricting means 228.

The rear electrode unit 207 includes a rear electrode 235 and a support member 236 for supporting the linearly elongated hot cathodes 206, with a predetermined spacing being maintained therebetween by an insulation layer 237. The rear electrode 235 is formed, on the hot cathodes side thereof via insulation layers, with conductive films divided in the direction normal to the hot cathodes 206 at positions corresponding to the electron beam passage holes 210*a*. By applying a predetermined voltage to these conductive films, the electron beams are modulated. The support member 236 is formed with holes 236*a* at positions corresponding to the electron beam passage holes 210*a*, and is also formed with an insulation layer on its hot cathodes 206 side. By contacting the heat electrodes 206 with bars 236*b* between respective holes 236*a* via the insulation layers, vibration of the heat electrodes can be prevented.

Meanwhile, the fourth metallic pins 227 for coupling the front electrode unit 205 with the rear electrode unit 207 are fixed at predetermined positions to the electron beam control electrode 211 by welding, etc. The fourth pins 227 are inserted into through holes 220*a* formed in the insulation spacers 220, and through holes 210*a* formed in the electron beam control electrode 210, and are further inserted into through holes 222*a* formed in the insulation spacers 222. On the support member 236 of the rear electrode unit 207, there are formed exit holes 236*c* for the head portions of the second pins 225, the second electrode section 205*b* and through holes 236*d* for the fourth pins 227. In the rear electrode 235, there are formed through holes 235*a* for the fourth pins 227. Through holes 223*a* of insulation spacers 223 are inserted onto the fourth pins 227 projecting from the rear electrode unit 207, and the head portion of the fourth pins 227 are melted, for example, by laser, to thereby couple the electrode unit 205 with the rear electrode unit 207.

In this manner, the assembly of the electrode unit 205 and the rear electrode unit 207 is constructed.

It is to be noted here that each of the insulation spacers 217 has a thickness equal to or smaller than that of the insulation spacers 218, each of the insulation spacers 219 has a thickness equal to or smaller than that of the insulation spacers 220, and each of the insulation spacers 221 has a thickness equal to or smaller than that of the insulation spacers 222.

Meanwhile, in the present embodiment, although the case of five electron beam control electrodes is described, the number of electron beam control electrodes is not limited to five. Also, the first electrode section 205*a* which has it components coupled together by the first pins 224 is not limited to the electron beam control electrodes 212, 213 and 214, and the second electrode section 205*b* which has its components coupled together by the second pins 226 is not limited to the electron beam control electrodes 210 and 211. Furthermore, the electron beam control electrode to which the third pins 226 are fixed for coupling and fixing the first electrode section 205*a* with the second electrode section 205*b* may be any electron beam control electrode coupled by the first pins 224 excluding that confronting the fluorescent screen 203.

The electron beam control electrode to which the fourth pins 227 are fixed for coupling and fixing the front electrode unit 205 with the rear electrode unit 207 may be any electron beam control electrode excluding the electron beam control electrode 214 confronting the fluorescent screen 203. Furthermore, the electrode unit may be divided into more than three stages in the lamination direction.

Since the operation of this embodiment is the same as in the first embodiment, the explanation thereof is omitted.

According to the above arrangement of the present embodiment, due to the fact that a plurality of electron beam control electrodes are fixed through insulation spacers by first, second and third pins without deformation thereto and a predetermined spacing is maintained therebetween, and because the front electrode unit is constructed at room temperature without heating, oxidization thereof can be prevented. The areas of the insulation spacers are maintained the smallest possible at areas necessary for coupling the electrodes, such that the electrostatic capacitances between respective electron beam control electrodes can be decreased. For example, in the case of the third preferred embodiment of the present invention, the electrostatic capacitances can be made 1/10 to 1/20 of the value obtained conventionally.

Furthermore, since the front electrode unit is divided into two stages in the lamination direction and coupled together with first and second pins, and the first pins are fixed to an electron beam control electrode other than electron beam control electrode confronting the hot cathodes, deformation of the electron beam control electrodes arising from the temperature differences therebetween accompanying the heating of the hot cathodes can be prevented from affecting the strip-shaped heat electrodes which constitute the electron beam control electrode confronting the fluorescent screen.

Furthermore, since coupling of the front electrode unit with the rear electrode unit is effected by the fourth pins fixed on an electron beam control electrode excluding the electron beam control electrode confronting the fluorescent screen, the strains arising from coupling of the front electrode unit and the rear electrode unit can be prevented from affecting the strip-shaped electrodes which constitute the electron beam control electrode confronting the fluorescent screen.

As described above, by preventing the deformation of the strip-shaped electrodes which constitute the electron beam control electrode confronting the fluorescent screen, an excellent blur-less image can be displayed, and by maintaining the electrostatic capacitances between the electrodes at minimum, a display apparatus having a small drive power can be obtained.

As is clear from the foregoing description, in the display apparatus according to the present invention, a plurality of electron beam control electrodes are coupled together with pins without deformation of the electrodes, predetermined spacing therebetween is maintained by insulation spacers. By constructing oxidization of the electrode unit can be prevented. Furthermore, by maintaining the areas of the insulation spacers to the smallest possible areas necessary to couple the electrodes, the electrostatic capacitances can be decreased.

Furthermore, since the coupling of the rear electrode unit with the front electrode unit is effected by pins fixed on the electron beam control electrode excluding the electron beam control electrode confronting the fluorescent screen, the strain arising from the coupling of the rear electrode unit with the electrode unit can be prevented from affecting the strip-shaped electrodes.

Furthermore, since the front electrode unit is divided in the lamination direction, and the pins fixed on an electron beam control electrode confronting the fluorescent screen do not confront the hot cathodes, deformation of the respective electron beam control electrodes due to temperature differences therebetween accompanying the heating of the heat electrodes can be prevented from affecting the strip-shaped electrodes confronting the fluorescent screen.

Accordingly, an excellent blur-less image can be displayed, and by maintaining the electrostatic capacitances between respective electron beam control electrodes sufficiently small, a display apparatus having a small drive power can be obtained.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

We claim:

1. A display apparatus comprising:

a rear electrode unit which includes a rear electrode, said rear electrode unit being disposed at a rear side of said display apparatus;

a face plate disposed at a front side of said display apparatus;

a fluorescent screen formed on said face plate;

a front electrode unit disposed between said rear electrode unit and said fluorescent screen, said front electrode unit including a plurality of electron beam control electrodes laminated relative to one another, and a plurality of insulation spacers disposed between each adjacent pair of said electron beam control electrodes to maintain predetermined spacing therebetween;

an electron beam generating source disposed between said rear electrode unit and said front electrode unit;

first coupling means for coupling together said electron beam control electrodes of said front electrode unit, said first coupling means including a first plurality of pins fixed to a forwardmost one of said electron beam control electrodes of said front electrode unit and extending through at least one other of said electron beam control electrodes; and second coupling means for coupling said front electrode unit with said rear electrode unit, said second coupling means including a second plurality of pins fixed to one of said electron beam control electrodes other than said forwardmost one of said electron beam control electrodes and extending rearwardly through said rear electrode unit.

2. A display apparatus as recited in claim 1, wherein said pins of said first coupling means and of said second coupling means extend in a forward-to-rearward direction; and said pins of said first coupling means are offset relative to said pins of said second coupling means, respectively, in directions normal to said forward-to-rearward direction.

3. A display apparatus as recited in claim 2, wherein said first plurality of pins of said first coupling means constitutes first coupling pins which are fixed to said forwardmost electron beam control electrode and extend through the remaining electron beam control electrodes of said front electrode unit; and said second plurality of pins of said second coupling means constitutes second coupling pins.

4. A display apparatus as recited in claim 3, wherein each of said first coupling pins extends through through-holes formed in said electron beam control electrodes other than said forwardmost electron beam control electrode and through through-holes formed in a plurality of said insulation spacers in registry with said through-holes in said electron beam control electrodes; and each of said second coupling pins extends through a through-hole formed in said rear electrode, through a through-hole formed in at least one of said electron beam control electrodes, and through through-holes formed in a plurality of said insulation spacers in registry with said through-hole of said rear electrode and said through-hole of said at least one electron beam control electrode.

5. A display apparatus as recited in claim 2, wherein said front electrode unit includes a first electrode section comprising a first plurality of said electron beam control electrodes including said forwardmost electron beam control electrode, and a second electrode section comprising a second plurality of said electron beam control electrodes;

said first plurality of pins of said first coupling means constitutes first coupling pins which are fixed to said forwardmost electron beam control electrode and extend rearwardly through the remainder of said first plurality of electron beam control electrodes;

said first coupling means further includes second coupling pins which are fixed to one of said first plurality of electron beam control electrodes other than said forwardmost electron beam control electrode and extend rearwardly through all of said second plurality of said electron beam control electrodes; and said second plurality of pins of said second coupling means constitutes third coupling pins.

6. A display apparatus as recited in claim 5, wherein each of said first coupling pins extends through through-holes formed in said first plurality of said electron beam control electrodes other than said forwardmost electron beam control electrode and through through-holes formed in a plurality of said insulation spacers in registry with said through-holes in said first plurality of electron beam control electrodes;

each of said second coupling pins extends through through-holes formed in said second plurality of electron beam control electrodes, and through through-holes formed in a plurality of said insulation spacers in registry with said through-holes in said second plurality of said electron beam control electrodes; and each of said third coupling pins extends through a through-hole formed in said rear electrode, through a through-hole formed in at least one of said electron beam control electrodes, and through through-holes formed in a plurality of said insulation spacers in registry with said through-holes of said rear electrode and said through-hole of said at least one electron beam control electrode.

7. A display apparatus as recited in claim 2, wherein said front electrode unit includes a first electrode section comprising a first plurality of said electron beam control electrodes including said forwardmost electron beam control electrode, and a second electrode section comprising a second plurality of said electron beam control electrodes;

said first plurality of pins of said first coupling means constitutes first coupling pins which are fixed to said forwardmost electron beam control electrode and extend rearwardly through the remainder of said first plurality of electron beam control electrodes;

said first coupling means further includes second coupling pins which are fixed to a forwardmost of said second plurality of said electron beam control electrodes and extend rearwardly through the remainder of said second plurality of electron beam control electrodes, and third coupling pins which are fixed to one of said first plurality of said electron beam control electrodes other than said forwardmost electron beam control electrode of said first plurality of electron beam control electrodes and extend rearwardly through at least one of said second plurality of said electron beam control electrodes; and said pins of said second coupling means constitutes fourth coupling pins.

8. A display apparatus as recited in claim 7, wherein each of said first coupling pins extends through through-holes formed in said first plurality of said electron beam control electrodes other than said forwardmost electron beam control electrode of said first plurality of electron beam control electrodes and through through-holes formed in a plurality of said insulation spacers in registry with said through-holes in said first plurality of electron beam control electrodes;

each of said second coupling pins extends through through-holes formed in said second plurality of electron beam control electrodes other than said forwardmost of said second plurality of said electron beam control electrodes, and through through-holes formed in a plurality of said insulation spacers in registry with said through-holes in said second plurality of said electron beam control electrodes;

each of said third coupling pins extends through a through-hole formed in said at least one of said second plurality of said electron beam control electrodes, and through through-holes formed in a plurality of said insulation spacers in registry with said through-hole in said at least one of said second plurality of said electron beam control electrodes; and each of said fourth coupling pins extends through a through-hole formed in said rear electrode, through a through-hole formed in at least one of said electron beam control electrodes, and through through-holes formed in a plurality of said insulation spacers in registry with said through-hole of said rear electrode and said through-hole of said at least one electron beam control electrode.

9. A display apparatus as recited in claim 2, wherein each of said pins of said first coupling means and of said second coupling means comprises a metallic pin.

10. A display apparatus as recited in claim 1, wherein said first plurality of pins of said first coupling means constitutes first coupling pins which are fixed to said forwardmost electron beam control electrode and extend through the remaining electron beam control electrodes of said front electrode unit; and said second plurality of pins of said second coupling means constitutes second coupling pins.

11. A display apparatus as recited in claim 10, wherein each of said first coupling pins extends through through-holes formed in said electron beam control electrodes other than said forwardmost electron beam control electrode and through through-holes formed in a plurality of said insulation spacers in registry with said through-holes in said electron beam control electrodes; and each of said second coupling pins extends through a through-hole formed in said rear electrode, through a through-hole formed in at least one of said electron beam control electrodes, and through through-holes formed in a plurality of said insulation spacers in registry with said through-hole of said rear electrode and said through-hole of said at least one electron beam control electrode.

12. A display apparatus as recited in claim 1, wherein said front electrode unit includes a first electrode section comprising a first plurality of said electron beam control electrodes including said forwardmost electron beam control electrode, and a second electrode section comprising a second plurality of said electron beam control electrodes;

said first plurality of pins of said first coupling means constituted first coupling pins which are fixed to said forwardmost electron beam control electrode and extend rearwardly through the remainder of said first plurality of electron beam control electrodes;

said first coupling means further includes second coupling pins which are fixed to one of said first plurality of electron beam control electrodes other than said forwardmost electron beam control electrode and extend rearwardly through all of said second plurality of said electron beam control electrodes; and said second plurality of pins of said second coupling means constitutes third comprising pins.

13. A display apparatus as recited in claim 12, wherein each of said first coupling pins extends through through-holes formed in said first plurality of said electron beam control electrodes other than said forwardmost electron beam control electrode and through through-holes formed in a plurality of said insulation spacers in registry with said through-holes in said first plurality of electron beam control electrodes;

each of said second coupling pins extends through through-holes formed in said second plurality of electron beam control electrodes, and through through-holes formed in a plurality of said insulation spacers in registry with said through-holes in said second plurality of said electron beam control electrodes; and each of said third coupling pins extends through a through-hole formed in said rear electrode, through a through-hole formed in at least one of said electron beam control electrodes, and through through-holes formed in a plurality of said insulation spacers in registry with said through-hole of said rear electrode and said through-hole of said at least one electron beam control electrode.

14. A display apparatus as recited in claim 1, wherein said front electrode unit includes a first electrode section comprising a first plurality of said electron beam control electrodes including said forwardmost electron beam control electrode, and a second electrode section comprising a second plurality of said electron beam control electrodes;

said first plurality of pins of said first coupling means constitutes first coupling pins which are fixed to said forwardmost electron beam control electrode and extend rearwardly through the remainder of said first plurality of electron beam control electrodes;

said first coupling means further includes second coupling pins which are fixed to a forwardmost of said second plurality of said electron beam control electrodes and extend rearwardly through the remainder of said second plurality of electron beam control electrodes, and third coupling pins which are fixed to one of said first plurality of said electron beam control electrodes other than said forwardmost electron beam control electrode of said first plurality of electron beam control electrodes and extend rearwardly through at least one of said second plurality of said electron beam control electrodes; and said second plurality of pins of said second coupling means constitutes fourth coupling pins.

15. A display apparatus as recited in claim 14, wherein each of said first coupling pins extends through through-holes formed in said first plurality of said electron beam control electrodes other than said forwardmost electron beam control electrode of said first plurality of electron beam control electrodes and through through-holes formed in a plurality of said insulation spacers in registry with said through-holes in said first plurality of electron beam control electrodes;

each of said second coupling pins extends through through-holes formed in said second plurality of electron beam control electrodes other than said forwardmost of said second plurality of said electron beam control electrodes, and through through-holes formed in a plurality of said insulation spacers in registry with said through-holes in said second plurality of said electron beam control electrodes;

each of said third coupling pins extends through a through-hole formed in said at least one of said second plurality of said electron beam control electrodes, and through through-holes formed in a plurality of said insulation spacers in registry with said through-hole in said at least one of said second plurality of said electron beam control electrodes; and each of said fourth coupling pins extends through a through-hole formed in said rear electrode, through a through-hole formed in at least one of said electron beam control electrodes, and through through-holes formed in a plurality of said insulation spacers in registry with said through-hole of said rear electrode and said through-hole of said at least one electron beam control electrode.

16. A display apparatus as recited in claim 1, wherein each of said pins of said first coupling means and of said second coupling means comprises a metallic pin.

* * * * *